US007628596B2

(12) United States Patent
Staton et al.

(10) Patent No.: US 7,628,596 B2
(45) Date of Patent: Dec. 8, 2009

(54) POWER STEERING PUMP

(75) Inventors: Timothy Matthew Staton, Dexter, MI (US); Brian Stanley Modrzejewski, Livonia, MI (US); David R. Hartman, Brighton, MI (US); Brandon William Bailey, Dearborn, MI (US); Michael Dean Strickler, Whitmore Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 127 days.

(21) Appl. No.: 11/534,409

(22) Filed: Sep. 22, 2006

(65) Prior Publication Data

US 2008/0075615 A1 Mar. 27, 2008

(51) Int. Cl.
*F04C 18/00* (2006.01)
*F01C 19/00* (2006.01)

(52) U.S. Cl. ..... 418/268; 418/82; 418/133; 418/149

(58) Field of Classification Search ..... 418/259, 418/131, 133, 134, 268, 82
See application file for complete search history.

(56) References Cited

U.S. PATENT DOCUMENTS 2,255,783 A * 9/1941 Kendrick ..... 418/82
2,256,459 A * 9/1941 Kendriek ..... 418/82
2,809,595 A * 10/1957 Adams et al. ..... 418/82
3,162,141 A * 12/1964 Vlachos ..... 418/268
3,216,363 A * 11/1965 Snow et al. ..... 418/268
3,421,413 A * 1/1969 Adams et al. ..... 418/133
3,762,843 A * 10/1973 Suzuki et al. ..... 418/268
5,017,098 A * 5/1991 Hansen et al. ..... 418/268
5,111,660 A * 5/1992 Gettel ..... 60/468
5,213,491 A * 5/1993 Fujiwara et al. ..... 418/133
6,068,461 A * 5/2000 Haga et al. ..... 418/259
6,082,983 A * 7/2000 Hayashi et al. ..... 418/133
6,375,441 B1 * 4/2002 Ichizuki et al. ..... 418/133
6,478,559 B2 * 11/2002 Bishop et al. ..... 418/133
6,481,990 B2 * 11/2002 Wong et al. ..... 418/133
6,537,047 B2 * 3/2003 Walker ..... 418/133
6,666,670 B1 * 12/2003 Hartman et al. ..... 418/133
2001/0036411 A1 * 11/2001 Walker ..... 418/133
2002/0119065 A1 * 8/2002 Palakodati et al. ..... 418/259
2003/0068247 A1 * 4/2003 Varghese ..... 418/268
2004/0202565 A1 * 10/2004 Yao et al. ..... 418/268

* cited by examiner

*Primary Examiner*—Thomas E Denion
*Assistant Examiner*—Mary A Davis
(74) *Attorney, Agent, or Firm*—Fredrick Owens

(57) ABSTRACT

A power steering pump for an automotive vehicle including a housing defining a compartment, a cam plate disposed within the housing, a rotor disposed within the housing and a lower pressure plate disposed within the housing between the cam plate and a closed end of the housing. A cover sealingly engages the housing to close an open end of the housing. The cover includes under vane porting to provide a fluid path from an outlet port on the cover to the rotor.

3 Claims, 4 Drawing Sheets

POWER STEERING PUMP

CROSS-REFERENCE TO RELATED APPLICATIONS

Not applicable.

BACKGROUND OF THE INVENTION

1. Field of the Invention

The present invention relates generally to power steering pumps and more specifically to a power steering pump having a cover plate containing pump vane porting.

2. Description of Related Art

A power steering system used with an automotive vehicle typically utilizes a power steering pump that provides hydraulic fluid under pressure to a power steering gear assembly. The pump includes a cam plate having a cam chamber. A rotor, mounted for rotation on a shaft journaled in the housing, is located in the cam chamber. The rotor includes retractable or moveable vanes that move radially in and out depending on their location or position in the cam chamber. The cam plate is disposed between upper and lower pressure plates and located within a housing of the pump. A cover plate secures the cam plate, rotor and pressure plates within the housing.

During operation, the vehicle engine, using a belt and pulley mechanism connected to shaft journaled in the housing drives the rotor. As the rotor turns, the vanes operate to compress and discharge the pressurized fluid through fluid passageways to the outlet port and ultimately to the power steering gear assembly. At least one fluid inlet port supplies fluid to the cam chamber.

The upper pressure plate located between the cover and cam plate typically has porting or passageways that route the power steering fluid. Accordingly, the upper pressure plate cooperates with the cover to route or provide high-pressure fluid from the outlet port through under vane porting on the upper pressure plate to correspondingly distribute fluid into the cavities underneath the vanes to drive the vanes out at certain locations or positions in the cam chamber. The upper pressure plate also has porting that relieves or enables the pressure to escape and allow the vanes to retract of extend radially inward as they travel within the cam chamber.

In addition, sealing the assembly within the housing, the cover plate may include an aperture or bore that supports the shaft bushing. Accordingly, rotation of the rotor provides pressurized fluid to the fluid output port and to the cam chamber to move the rotor vanes. Due to the intricacy of the fluid ports and passageways, the cam plate and pressure plates must be accurately aligned with respect to one another in the housing whereby the cam chamber is properly aligned with the inlets and outlets to ensure proper pressure flow. To ensure a proper fit and seal it is necessary to grind the two side surfaces of the upper pressure plate and the surface of the cover. This process increases the cost of the pump and provides an additional leak path.

Therefore there exists a need for a power steering pump that utilizes a single component that combines the upper pressure plate and cover into a single piece that includes the fluid inlet and outlet porting along with the under vane porting. Such a pump reduces the number of components and potential leak paths.

SUMMARY OF THE INVENTION

The present invention provides a power steering pump for an automotive vehicle that includes a housing having a compartment. The housing includes a closed end and an open end. A cam plate is disposed within the housing. A rotor is also disposed within the housing. The rotor includes retractable vanes that cooperate with the cam plate to pressurize fluid. A lower pressure plate is disposed within the housing between the closed end and the cam plate. In accordance with the invention, a cover sealingly engages the housing at the open end to close the open end. The cover includes a side face that contacts the cam plate. The cover also includes under vane porting which provides a fluid path from an outlet port on the cover to the rotor.

In accordance with a further aspect of the invention, the under vane porting includes a fluid conduit extending between an outlet port located on the cover and at least one fluid passage located on the cover and spaced from the outlet port. Thus, the fluid conduit provides a fluid flow path between the outlet port and the fluid passage. Accordingly the cover, besides sealing the pumping components in the housing communicates high-pressure fluid from the outlet port through the under vane porting located in the cover to the rotor.

DETAILED DESCRIPTION OF THE PREFERRED EMBODIMENTS

Figure 1:
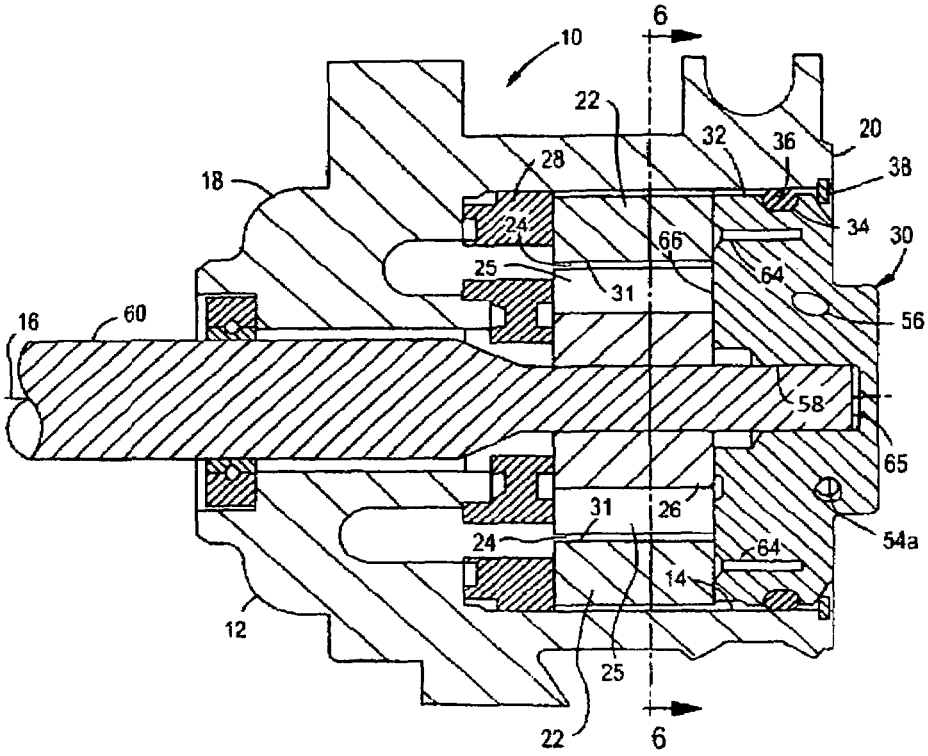
FIG. 1 is a cross-sectional view of a power steering pump in accordance with the present invention.

FIG. 1 illustrates a power steering pump 10, in accordance with a preferred embodiment of the present invention, for use in a power steering system of an automotive vehicle. The power steering pump 10 provides pressurized fluid to a power steering gear assembly. The pump 10 includes a housing 12 that defines a compartment surrounded by an inner wall 14 generally cylindrical about an axis 16. The housing 12 includes a closed end 18 and an open end 20 axially spaced from the closed end 18. A cam plate 22 is located in the compartment perpendicular to the axis 16. The cam plate 22 includes a cam chamber 24. A rotor 26 is disposed within the cam chamber 24. A lower pressure plate 28 is disposed within the compartment on one side of the cam plate 22 between a closed end 18 of the housing 12 and the cam plate 22. The lower pressure plate 28 includes two diametrically opposed inlet ports and two diametrically opposed outlet ports spaced approximately an equal angular distance from the inlet ports.

The power steering pump 10 further includes a cover 30. As illustrated in FIG. 1, the cover 30 is disposed within the open end 20 of the housing 12 adjacent and contacting the cam plate 22. The outer circumferential surface 32 of the cover 30 includes a groove 34 sized to receive a seal member, such as an O-ring. In the disclosed embodiment, the O-ring 36 forms a seal between the cover 30 and the housing 12. A retaining ring 38 engages the housing 12 and secures the cover 30 in a secure, fluid-tight position within the housing 12.

Figure 2:
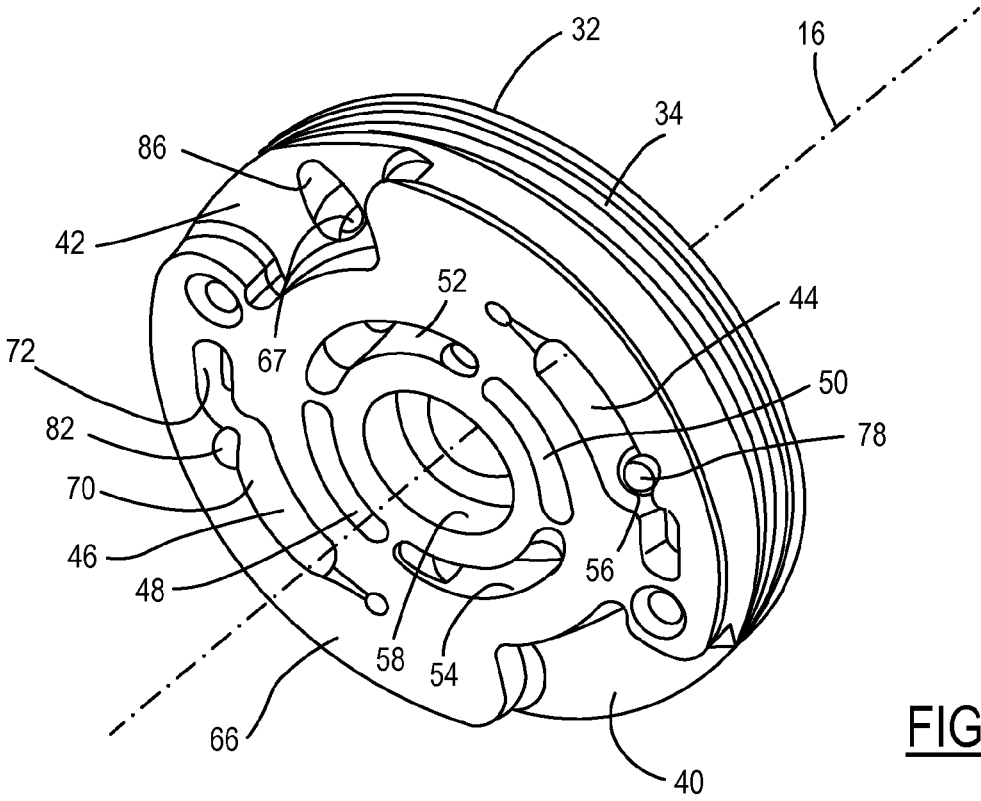
FIG. 2 is a perspective view of a cover for a power steering pump in accordance with the present invention.
Figure 3:
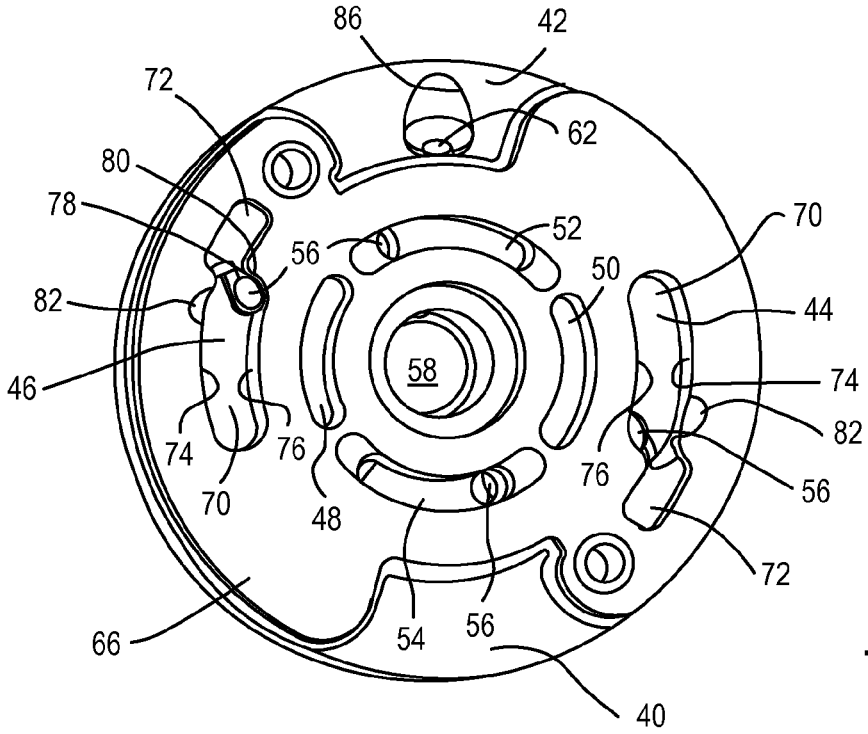
FIG. 3 is an additional perspective view of the cover of FIG. 2 taken at a different angle.
Figure 4:
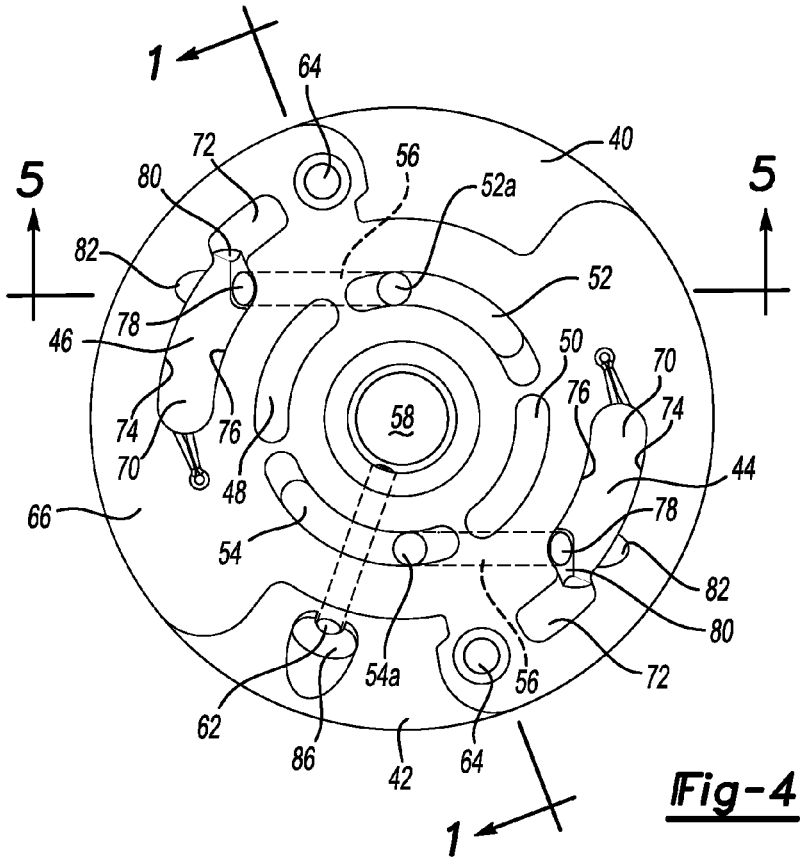
FIG. 4 is a front view of the cover for a power steering pump of FIG. 2.

As illustrated in FIGS. 2-4 the cover 30 includes two diametrically opposed inlet ports 40, 42 and two diametrically opposed outlet ports 44, 46.

The outlet ports 44, 46 each include a first portion 70 and a second portion 72. Each first portion 70 is adjacent and in fluid communication with the second portion 72 located radially outward from the first portion 70. As illustrated, the first and second portions 70, 72 are grooves or channels open to the planar side surface 66. The grooves or channels have opposing sidewalls 74, 76 that extend axially inward into the cover 30 from the planar side surface 66. The first portion 70 of outlet ports 44 and 46 is open to the cam chamber 24.

Figure 5:
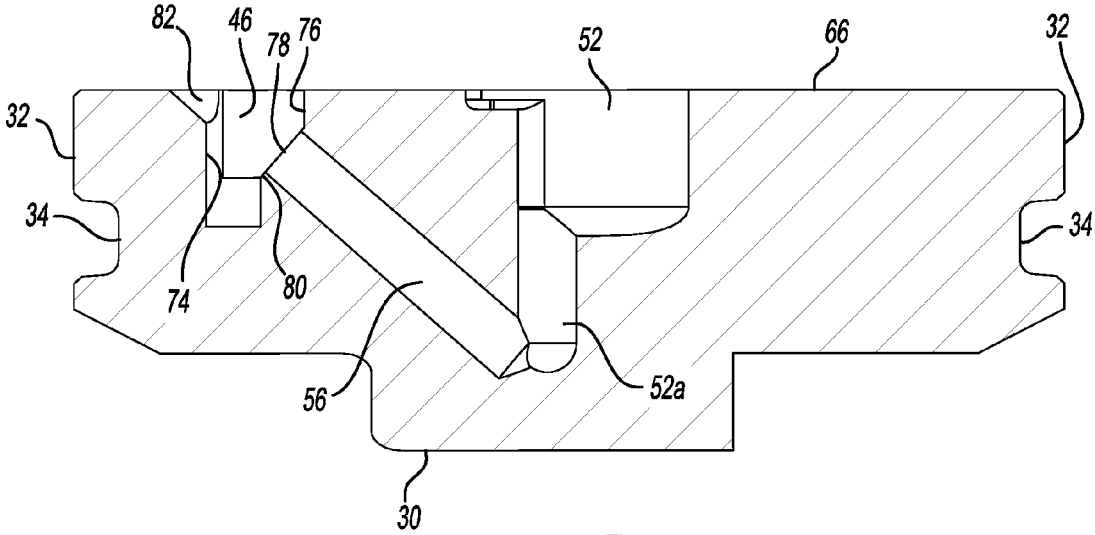
FIG. 5 is an enlarged cross-sectional view of the cover of FIG. 4 taken along lines 5-5 in the direction of the arrows.

As illustrated in FIGS. 4-5, the fluid conduits are formed in cover 30 and each include an opening 78 located on an angled surface 80 of the outlet ports 44 and 46 positioned at or near the junction of the first and second portions 70, 72 of the outlet ports 44 and 46. Accordingly, each fluid conduit 56 extends through one of the sidewalls 76 at an angle with respect to the planar side surface 66 of the cover 30. Depending upon the angle of the fluid conduit 56, a small groove or depression 82 is cut or formed in the planar side surface 66 adjacent the opposing sidewall 74.

The cover 30 also includes two pairs of fluid passages 48, 50, and 52, 54. As illustrated in FIG. 4, one pair of fluid passages 48, 50 is radially aligned with the outlet ports 44, 46. The other pair of fluid passages 52, 54 is radially aligned with the inlet ports 40, 42. The fluid passages 48, 50 and 52, 54 are generally arcuate in shape and open to the planar side surface 66, but do not axially extend through the cover 30. Accordingly, they form a plurality of arcuate grooves located about the axis 16. A pair of passageways or fluid conduits 56 correspondingly extend between the outlet ports 44, 46 and the pair of fluid passages 54, 52. Fluid passages 52, 54 provide under vane outlet port pressure feedback to the vane cavities 33 of rotor 26 when the vanes are rotated into the portion of the cam chamber 24 that is in fluid communication with the correspondingly radially aligned inlet ports 40, 42.

As illustrated, all of the under vane porting, including the passageways or fluid conduits 56 extending between the outlet ports 44, 46, and the fluid passage 54, 52, is contained within the cover 30. The term under vane porting is used herein to describe the ports or passageways used to transfer or enable fluid communication with the under vane cavities 33 located in the rotor 26. Under vane feedback pressure from the outlet ports 44, 46 is used to lift or force the vanes 25 outward against the cam profile surface 31 of the cam chamber 24 allowing the pump 10 to do work on the power steering fluid by drawing fluid from the inlet ports 40, 42 into the cam chamber 24.

Depending upon the cover 30 configuration, it may be necessary to deepen or extend a portion 52*a*, 54*a* of the fluid passage 52, 54 further into the cover 30 such that the passageways or fluid conduits 56 connect with the respective extended portions 52*a*, 54*a* of the fluid passages 52, 54 as is shown in FIGS. 4 and 5. For example, the portions 52*a*, 54*a* of the fluid passages 52, 54 may include an axially extending bore. The axially extending bore portions 52*a*, 54*a* may be formed by use of a conventional boring tool such as a drill to limit the angle of the passageway or fluid conduit 56 with respect to the planar side surface 66 of the cover 30. As shown in FIG. 5, the extension of portion 52*a* is formed into cover 30 to intersect the fluid conduit 56 based on the position of the outlet port 46 (or 44) with respect to the outer circumferential surface 32 of the cover 30. In some instances it may be possible to drill or bore a passageway through the outer circumferential surface 32 of the cover 30 and into the cover 30 substantially parallel to the planar side surface 66 to connect the outlet port 46 (or 44) and the fluid passage 52 (or 54). However, such an assembly may be prone to leak and sealing issues and may require a plug or other seal member placed in the outer circumferential surface 32.

Figure 6:
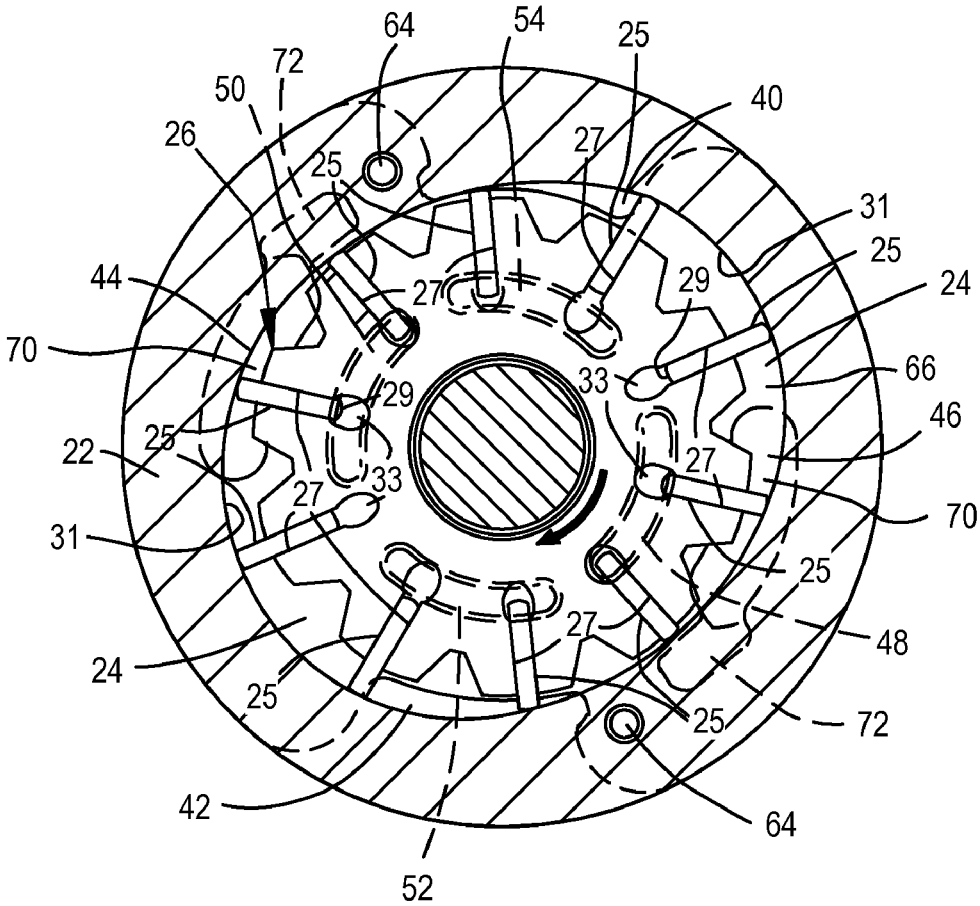
FIG. 6 is an enlarged cross-sectional view of the power steering pump taken along section line 6-6 in FIG. 1, without the housing.

The fluid passages 52-54 and passageways or fluid conduits 56 are part of the under vane porting used to control the flow of fluid from the outlet ports 44, 46 to the rotor 26. As shown in FIG. 1 and FIG. 6 , the rotor 26 contains a plurality of vanes 25 that move reciprocally in radial slots 27 located in the rotor 26. The radially outer end of each vane 25 contacts an inner surface 31 of the cam chamber 24. The radially inner end 29 of each vane 25 is located in or adjacent to a space or cavity 33 disposed at the end of the radial slot 27. The space or cavity 33 receives pressurized fluid used to urge the vane 25 radially outward against the cam profile surface 31 of the cam chamber 24. The chambers 33 at each end of each radial slot 27 are aligned with and communicate with the passageways 48, 50, 52 and 54 located in the cover 30. Accordingly during pump operation, fluid from the outlet ports 44, 46 travels through the passageways or fluid conduits 56 that connect the outlet ports 44, 46 with the fluid passages 54, 52. The passageways or fluid conduits 56 hydraulically connect the vanes 25 with the outlet ports 44, 46 and allow flow of high-pressure fluid through the under vane porting to urge the vanes outward in a radial direction against the inner surface of the cam chamber 24.

The cover 30 further includes a blind bore or socket 58 forming a support structure or assembly that receives and supports the shaft 60. Accordingly, the closed end 18 of the housing 12 supports one portion of the shaft 60 while the blind bore or socket 58 located in the cover 30 also supports the shaft 60. A fluid conduit 62 connects one of the inlet ports 42 with the blind bore or socket 58. Accordingly, fluid flows from the inlet port 42 to the socket 58 to provide lubrication for the shaft 60 during pump operation. In addition, the cover 30 also includes a plurality of apertures 64 used to properly align the cover 30 and correspondingly the under vane porting with the remaining elements of the power steering pump 10 including the cam plate 22, rotor 26, lower pressure plate 28 and housing 12.

Accordingly, the present invention provides a cover 30 containing outlet ports 44, 46, fluid passages 54, 52 and passageways or fluid conduits 56 extending directly from the outlet ports 44 to the fluid passages 54, 52. In this manner, the cover 30 serves to provide both the outlet port and the under vane porting. The cover 30 also includes inlet ports 40 and 42 in a one piece integration that eliminates the need for a separate under porting plate element. In addition, the cover 30 contains a blind bore or socket 58 machined with clearance tolerance and flow grooves for lubrication of the pump shaft 60 whereby one end or portion 65 of the shaft 60 is supported by the cover 30.

Accordingly, in the described embodiment, a single cover 30 is utilized to seal and secure the cam plate 22 within the housing 12 without the need for a upper pressure plate. Reducing the part count removes potential leak paths and eliminates the need for precision grinding of mating surfaces.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A power steering pump for an automotive vehicle comprising:

a housing defining a compartment, said housing further including an axis, a closed end and an open end;

a cam plate having a continuous cam profile surface disposed within said housing for defining a cam chamber;

a rotor, said rotor disposed within said housing for rotation about said axis, said rotor including a plurality of retractable vanes that cooperate with the cam plate to pressurize fluid within said cam chamber; said rotor further including radially extending slots having a base end nearest said axis and an open end at the outer surface of said rotor, wherein said slots are configured to receive said vanes and allow said vanes to slide radially and extend outward with respect to said rotor, and said slots contain under vane cavities at the base end of said slots for receiving fluid pressure to force individual ones of said plurality of retractable vanes radially outward toward said cam profile surface when the extended portions of said individual vanes are in fluid communication with a plurality of pump inlet ports;

a lower pressure plate disposed within said housing between said housing and said cam plate;

a cover sealingly engaging said housing at said open end to close said open end;

said cover having an outer circumferential surface with a groove located therein and an O-ring located in said groove;

said O-ring sealingly engaging an inner wall of said housing when said cover engages said housing;

said cover including a planar side face, said side face contacting said cam plate, said rotor and said vanes;

said cover integrally formed as a single element to include said plurality of pump inlet ports, and a plurality of pump outlet ports evenly distributed about said axis and all exposed to said cam chamber through said planar side face for fluid communication therewith;

said cover further including at least one conduit extending between said plurality of outlet ports and said under vane cavities to provide fluid pressure feedback from said outlet port to the base of said vanes when the extended portions of said vanes are in fluid communication with said plurality of pump inlet ports to force said vanes against said cam profile surface;

a shaft disposed within said housing with said rotor secured thereto; and said cover having an axially extending blind bore, said blind bore receiving and supporting one end of said shaft.

2. A power steering pump as set forth in claim 1, wherein said cover further including a fluid conduit extending from at least one of said plurality of pump inlet ports to said axially extending bore to provide lubrication to said shaft within said bore.

3. A power steering pump as set forth in claim 1 wherein said cover further includes a plurality of integrally formed passageways that contain arcuate shaped openings in said side surface, radially aligned with said plurality of pump inlet ports and positioned to underlie said under vane cavities in said rotor, and further wherein said arcuate shaped passageways are connected to said at least one conduit within said cover to communicate said feedback fluid pressure from said plurality of pump outlet ports to the base of vanes while having their extended portions in fluid communication with said pump inlet ports.

* * * * *